US006589388B1

(12) United States Patent
Nissinen

(10) Patent No.: US 6,589,388 B1
(45) Date of Patent: Jul. 8, 2003

(54) METHOD FOR MANUFACTURING COATED PAPER AND A COATED PAPER

(75) Inventor: Vilho Nissinen, Numminen (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/936,628

(22) PCT Filed: Mar. 10, 2000

(86) PCT No.: PCT/FI00/00191

§ 371 (c)(1),
(2), (4) Date: Sep. 12, 2001

(87) PCT Pub. No.: WO00/55424

PCT Pub. Date: Sep. 21, 2000

(30) Foreign Application Priority Data

Mar. 12, 1999 (FI) ..... 990558

(51) Int. Cl.[7] ..... D21F 11/00

(52) U.S. Cl. ..... 162/135; 162/204; 427/326; 428/337

(58) Field of Search ..... 162/119, 122, 162/135, 136, 137, 147, 204, 205, 265, 361, 360.2, 206, 207, 360.3; 118/65, 67, 68; 427/317, 324, 325, 326, 355, 361, 365; 428/211, 334, 332, 337; 100/162 R, 331, 38

(56) References Cited

U.S. PATENT DOCUMENTS

| | | | | | |
|---|---|---|---|---|---|
| 4,289,808 | A | * | 9/1981 | Huang | 427/209 |
| 5,286,348 | A | | 2/1994 | Perin | 162/262 |
| 5,320,897 | A | * | 6/1994 | Kondo et al. | 347/105 |
| 5,641,387 | A | * | 6/1997 | Baldini | 162/136 |
| 5,763,009 | A | * | 6/1998 | Kegasawa et al. | 162/177 |
| 5,817,215 | A | * | 10/1998 | Kinnunen | 118/58 |
| 5,916,420 | A | * | 6/1999 | Wurster et al. | 162/135 |
| 6,022,448 | A | * | 2/2000 | Eriksson et al. | 162/123 |
| 6,270,577 | B1 | * | 8/2001 | Shanton et al. | 118/249 |

FOREIGN PATENT DOCUMENTS

| | | | |
|---|---|---|---|
| DE | 195 45 408 A1 | 6/1997 | D21H/23/32 |
| JP | 04-361695 | 12/1992 | |
| JP | 05-279996 | 10/1993 | |

OTHER PUBLICATIONS

Engstrom, G and Lafaye, J.F., "Precalendering and its effect on paper–coating interaction", TAPPI Journal, Aug. 1992, pp. 117–122.*

* cited by examiner

*Primary Examiner*—Steven P. Griffin
*Assistant Examiner*—Eric Hug
(74) *Attorney, Agent, or Firm*—Cohen, Pontani, Lieberman & Pavane

(57) ABSTRACT

A method and apparatus for manufacturing paper, in which method base paper manufactured in a paper machine is calendered and coated to improve its printing properties. Before calendering, the moisture content of the manufactured base paper is brought to 4–14% of the total weight of the paper, after which the base paper web (2) is taken to a multi-nip calender (3), the base paper being calendered by the multi-nip calender (3) and the calendered base paper (2) coated on at least one side with a layer of coating.

39 Claims, 1 Drawing Sheet

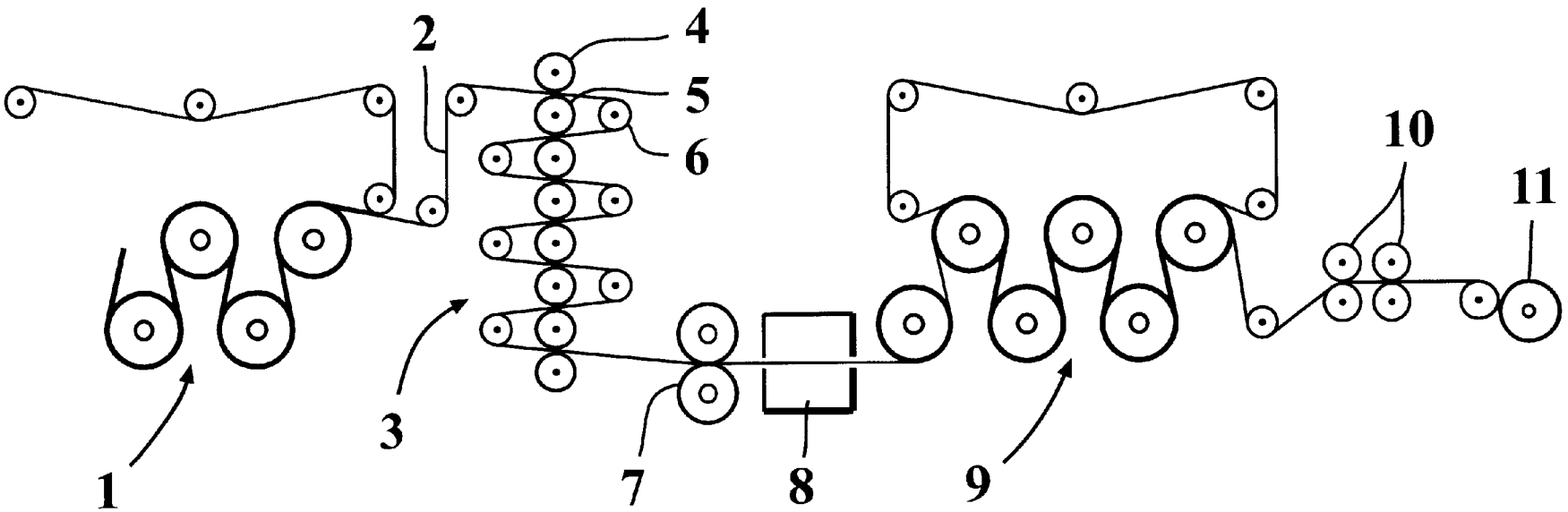
1
2
3
4
5
6
7
8
9
10
11

METHOD FOR MANUFACTURING COATED PAPER AND A COATED PAPER

PRIORITY CLAIM

This is a national stage of PCT application No. PCT/FI00/00191, filed on Mar. 10, 2000. Priority is claimed on that application, and on patent application No. 990558 filed in Finland on Mar. 12, 1999.

FIELD OF THE INVENTION

The present invention relates to a method and apparatus for manufacturing calendered and coated paper. The base paper is calendered using a multi-nip calender, for example, a super calender, an OptiLoad calender, or a Janus Concept calender.

BACKGROUND OF THE INVENTION

The invention concerns the manufacture of high-quality printing papers, using on-line calendering and coating. In on-line solutions, the coating stations and calender are located on the same line at the end of the paper machine, the paper web manufactured being led directly from the paper machine to finishing, without intermediate winding. Calendered paper grades are manufactured using off-line equipment, so that two or three separate calenders, each with its own unwinder and reel-up, are used with a single paper machine. The speed of known multi-nip calenders has prevented their use as on-line calenders with high-speed paper machines. However, new multi-nip calenders and coating stations have been developed, which run at speeds that can be raised to match those of paper machines, allowing them to be connected directly to the same production line as a paper machine. All multi-nip calenders have several nips, which usually comprise hard and soft rolls. The surface of the soft rolls is made from paper or some other suitable fibrous material, or, to an increasing extent nowadays, from a polymer material developed for this purpose. The hard rolls are generally manufactured from cast iron and occasionally from steel, and can usually be heated using oil, steam, or in some other way, for instance, by using induction heating.

Calendering is intended to improve the gloss, smoothness, and other properties of the surface of the paper relating to the printability of the paper. These properties affect the final print quality.

Smoothness for the print impression is created by subjecting the paper fibres simultaneously to heat and high pressure, by heating hard rolls and pressing the rolls against against each other with great force, to create a high delay pressure in the nip between them. Due to these forces, the paper fibres reach their glass transition temperature, so that the deformations due to the nip load become permanent. The slipping of the paper against the surfaces of the rolls may also increase the deformations in the paper and the smoothing effect.

When multi-nip calendering is used, the paper is usually manufactured in a paper machine and, if necessary, coated. In both cases, the uncoated or coated paper is usually wound onto a batch roll and calendered in a separate calender. The paper is dried to become extremely dry, with a moisture content of about 1–3% of the total weight of the paper, the paper then being re-wet before calendering to a relatively high moisture content of about 6–10%. The purpose of the drying to a low moisture content and re-wetting is to even the cross-direction (CD) moisture profile. This method is used especially in the manufacture of super-calendered, i.e. SC paper. The short period of storage on the batch roll evens variations in moisture, in the same way as re-wetting. In present-day on-line calendering, the paper is dried to a very low moisture content and is re-wet to a suitable moisture content for calendering, immediately before calendering. The method is thus nearly identical to that used in off-line calendering, except that the storage that evens the moisture content is not used.

Re-wetting can be carried out using, for example, the waterjet units disclosed in U.S. Pat. No. 5,286,348, which create a good moisture profile in the cross direction of the web.

Problems arising from drying and re-wetting include the time required for the moisture content to even out and the increased energy required to evaporate the water needed for wetting. The greater drying requirement increases the length of the machine and the space needed for it, compared to equipment in which wetting is not required. An uneven moisture content will lead to variations in smoothness and in the thickness profile, because the moisture content has a great effect on the deformation of the fibres. If the thickness profile is uneven, winding becomes difficult and transverse buckling may even occur in customer reels. This buckling reduces the paper's runnability in the preparing and printing machines and thus reduces the quality of the end product in the eyes of the customer.

Nowadays, the moisture profile of paper during manufacture is controlled in several ways, especially at the start of the formation of the web. In present processes, the control of the moisture profile is intended to ensure good runnability of the machine and the product being manufactured. This is understandable, because the tension profile, which greatly affects runnability, depends greatly on the moisture profile. In off-line calendering, the aim is to keep the moisture profile as even as possible, in those parts of the process in which it has the greatest effect on runnability.

A reason for coating paper is to improve its printability. Coating is used to influence the whiteness of the paper, the evenness of its surface, and the gloss of the print surface. Thus, coating has partly the same objectives as calendering. How thick a coating layer is used, what coating mixes are suitable, and how many times the paper is coated all depend on the use of the paper. The coating mix can be spread onto the surface of the paper in many different ways, each one of which creates a different final result, and surface on the end product. Usually, thicker coating and more coating layers will lead to a better print surface, so that, in art-paper grades, there may be several coating layers and a total coating amount of several tens of grams per square metre on each side of the paper. In lightweight coated printing (LWC) papers, the amount of coating on one side of the paper is significantly smaller, usually about 5–15 g/m$^2$. Smaller amounts of coating do not necessarily cover the entire surface of the paper, instead the coating remains in the valleys formed in the surface roughness of the paper by the action of the doctor blade or other evening device. Thus, the coating thickness varies according to the roughness profile of the paper, so that the properties of the print surface are not absolutely even. However, the printing properties of LWC paper are better than those of corresponding uncoated paper, so that its cheaper price makes it quite suitable for uses requiring a reasonably good print surface at a low price. Naturally, the properties of LWC paper depend decisively on the type and quality of the base paper, and on the amount and type of coating used. Because a small amount of coating will not greatly increase whiteness, the base paper itself must be sufficiently white. Thus, LWC base paper usually contains chemical pulp fibres, which are intended not only to increase strength, but also to improve whiteness. Due to its characteristics, LWC paper is not usually calendered, as calendering cannot substantially influence the properties of this paper grade.

Paper based on mechanical pulp containing a great deal of filler can only be coated, if the filler content is sufficiently low. Base paper manufactured from mechanical pulp is weaker than paper made from chemical wood-free pulp and the addition of fillers further reduces its strength. For example, even under favourable conditions, the maximum filler content that can be used in blade coating is 15%. Thus, paper at least partly based on mechanical pulp and containing a large amount of filler has not been manufactured.

Another problem relating to coated papers, and particularly those containing filler, is recyclability. If the paper is recycled for fibre, the filler and coating must be removed, which demands a great deal of energy and especially strong chemicals. If this type of paper is finally used as a fuel, the coating and fillers remain as unburned ash, which hinders combustion and which is difficult to exploit economically. The amount of ash is also affected by the quality of fibre in the base paper. Though pulp will burn almost completely, groundwood fibres contain incombustible substances, which increase the amount of ash.

SUMMARY OF THE INVENTION

The invention is intended to create an entirely new type of method, by means of which it is possible to manufacture a new type of paper, and achieve, at lower cost, at least the same quality of print surface as in present paper grades intended for corresponding uses, especially LWC paper grades.

The invention is based on the calendering the manufactured paper web in a multi-nip calender while wet and then coating the calendered paper with a very small amount of coating. The resulting paper preferably has a layer of coating on at least one side with a maximum grammage of 5 g/m$^2$.

Considerable advantages are gained with the aid of the invention.

The invention can be used to produce paper of a quality corresponding to LWC paper, with lower production costs, by very lightly coating a base paper produced from groundwood fibre. The invention can be used to manufacture coated paper from a base paper of low basic strength, because calendering carried out according to the invention increases the strength of paper. By optimizing the process, it is even possible to achieve a higher quality. The method can be used to reduce the price of high-quality lightweight-coated printing paper to an entirely new level. Because the total amount of coat is reduced, the amount of substance to be separated in recycling is reduced, compared to coated paper made form a corresponding base paper. Because the amount of coating is small, the grammage of the base paper can be correspondingly greater, allowing the use of fibres providing a lower strength, or a large amount of filler, without decreasing the paper's strength or runnability. If it is possible to use groundwood fibre and a large amount of filler instead of pulp fibre, the price of the base paper will remain low, while, when using thin coating layers, the price of the coating will also be low. Because only a small amount of coating is used, and its dry substance content can be high, the dryer output required is significantly less than in the manufacture of LWC, for example. Thanks to the reduction in dryer output, the machine can be shortened and the energy consumption per tonne of paper manufactured reduced.

If multi-nip calendering takes place before coating, an extremely smooth paper surface is obtained before coating and the same smoothness is transferred to the properties of the coated paper. The calendered surface absorbs less water and the processed fibres expand less. Thus, thanks to precalendering, there is no substantial fibre roughening during coating, which would increase the roughness of the surface after coating. This property is extremely important when using a thin coating, because a thin coating layer will not cover possible roughening as well. In the same way, the small amount of water contained in a very thin coating layer will reduce the absorption of water by the fibres, accelerating drying and shortening the absorption time of the water.

While the invention is preferably applied in on-line processes, making the entire manufacturing line compact, it is also possible to apply the invention to solutions, in which the manufacturing of the base paper, calendering, and coating take place in different stages. However, in such cases, it may be difficult to control aspects such as the moisture content of the paper going to calendering, without additional wetting, which will increase costs. In other ways too, off-line manufacturing procedures are usually more expensive than on-line methods.

Due to the small amount of coating, little wetting of the base paper is needed, so that runnability remains good, as the wetting does not decrease the strength of the base paper. Also the paper fibres only expand slightly, partly due to the effect of calendering and partly due to the small amount of water absorbed.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention is examined with the aid of the accompanying drawing, which shows one arrangement for manufacturing paper according to the invention.

DETAILED DESCRIPTION OF THE PRESENTLY PREFERRED EMBODIMENTS

The FIGURE shows a paper machine finishing section, which is arranged according to the invention. In this case, the paper is made in a paper machine and dried to the desired final dryness in the dryer cylinder group 1. From dryer cylinder group 1, the paper web is taken to a multi-nip calender 3, which is preferably an OptiLoad calender, in which the pressures in the various roll nips can be adjusted independently, unlike in a super-calender, in which the nip load is created by compressing the entire group of rolls. In addition to an OptiLoad and a super-calender, other multi-nip calenders that achieve a sufficient web smoothness, can be used, for example, Janus Concept calenders. An OptiLoad calender consists of hard heated rolls 4 arranged on top of each other, with soft rolls 5 set between them. The arrangement of the rolls can be varied, and both the soft and hard rolls can be used as loading rolls, according to the construction of the calender. The paper web 2 is guided through the calender and roll nips by means of guide rolls 6. Because multi-nip calenders are, as such, known, their construction and the various loading and roll-nip formations and methods of heating the rolls are not described here in greater detail.

After calender 3, the web is led to coating station 7, which, in this example, is a two-sided, film-transfer coater. Alternatively, the coating station may be a two-sided spray coating station, or two one-sided stations set sequentially. The use of various kinds of short dwell time coaters can also be considered, but it is very difficult to use them to achieve the small amounts of coating in the preferred operating range of the invention. The use of blade coaters, foam coaters, or curtain coaters can also be considered, but the film transfer method and spray application appear to be preferable in terms of paper quality and can be used to achieve the most advantageous amount of coating from the point of view of the invention. After the coating station, there is a contactless dryer 8, which can be of any known type, and a dryer cylinder group 9. From dryer cylinder group 9, the web is taken to winder 11 through drive nips 10, which help to maintain the tension of the web. If it is desired to further improve the gloss contrast of the paper, the paper can also be treated, for example, with a soft calender, before winding. In place of the manner of drying referred to above, other drying methods and combinations of them can also be used.

According to the invention, the paper 2 manufactured in the paper machine is dried to a suitable moisture content for calendering and then led to multi-nip calender 3. The moisture content of paper to be calendered should be 4–14% of the total weight of the paper, the typical moisture percentage being 7–10%, preferably 8–10%. At this paper moisture content, a multi-nip calender can be used to achieve a PPS-S10 roughness, which is at most 2.5 $\mu$m and even 1–1.5 $\mu$m PPS-S10. Calendering also compacts the surface of the paper. In such a case, the quality of the paper surface is optimal for film-transfer coating and also highly suitable for spray coating. A common feature of these coating methods is that they can spread a very small amount of coating evenly on the surface of the paper. Because the surface of paper calendered in the manner described above is extremely dense and even, very little coating containing dry substances penetrates between the fibres of the paper and there are no unevennesses to create valleys in which the coating could collect. Thus, the excellent evenness of the paper becomes repeated as evenness in the coated surface and the surface acquires an excellent quality. Even a thin layer of coating spread on an even surface will give a good cover, because the coating layer is of an even thickness over the whole surface of the paper, so that its covering power is exploited optimally. The coating used can be any so-called pigment coating, such as kaolin or calcium carbonate, which contains solid particles, polymer compounds, or similar, which remain on the surface of the paper. According to the preferred embodiment of the invention, the base paper contains a considerable amount of filler, i.e. at least 15% and preferably at least 20%. The filler is used to improve the calendering result and can reduce the price of the base paper even further. The filler used can be any filler normally used in paper making, for example, the same substances that are used in the coating.

The method according to the invention has been used in trial runs, in which coating amounts of 2, 3, and 5 g/m$^2$/side were spread onto the surface of super-calendered paper, using a spray coater and an Optisizer film-transfer coater. The best quality was achieved using an amount of 2–3 g/m$^2$ to coat the surface of super-calendered paper. The quality of the printed surface was better than that of the reference, super-calendered filler containing paper of 57 g/m$^2$ SC, the fibre roughness of the paper being better than that of 51 g/m$^2$ LWC. An excellent gloss contrast was achieved between the printed and unprinted surfaces, without final calendering,.

EXAMPLE

The following example compares the advantages of the method according to the invention with a product of the traditional LWC manufacturing method, which has a grammage of 60 g/m$^2$.

| Aspect compared | New concept | LWC |
|---|---|---|
| Mechanical pulp | 40 g/m$^2$ | 22 g/m$^2$ |
| Base paper chemical pulp | — | 16" |
| Base paper ash | 16" | 2" |
| Coating amount | 4" | 20" |
| Moisture content after paper machine | 8–10% | 2–3% |
| Efficiency | 88% | 82% |
| Coating | 2 side SS | 2 blade |
| Coating drying | 1 × 4 g/m$^2$ | 2 × 10 g/m$^2$ |
| Machine length | 85% | 100% |

The mechanical pulp and base paper pulp above refer to the fibre material used in the base paper, the base paper ash refers to the amount of ash remaining after combustion, which particularly depicts the amount of filler. The efficiency is the operating efficiency, which depicts the number of breaks. Coating was carried out on two Symsizer™ film-transfer coaters and correspondingly on two blade coaters. As the comparison shows, the arrangement according to the invention is superior in terms of the drying arrangements, if the amount of energy required and the length of the machine are taken into account. The length of the machine correlates directly with its price.

The following prices (in Finnish Marks) can be used to calculate the relative manufacturing costs for paper according to the invention and the LWC paper referred to above.

| | |
|---|---|
| Mechanical pulp | FIM 1500/t |
| Chemical pulp | FIM 2500/t |
| Ash | FIM 600/t |
| Coating | FIM 1500/t |
| Energy | FIM 100/MWh |

Because the prices of the various production factors may vary, the prices given above are only indicative. A calculation based on them shows that its is about 28%/tonne cheaper to manufacture paper according to the invention than to manufacture LWC paper. The greatest savings are due to the possibility to use paper made from groundwood, instead of paper containing chemical pulp. The rest of the savings arise from replacing fiber with filler and from energy savings. In addition, improved efficiency increases production by 6% and reduces investment costs.

Embodiments of the invention, differing from those disclosed above, can also be envisaged.

Naturally, the base paper of the paper according to the invention can contain or be woodfree pulp, but this will increase its price substantially. Measurement and control devices to control the process are an essential part of the equipment. These are, for example, moisture content measurement and control devices. However, these devices do not come within the scope of the invention and are not described in greater detail.

Thus, while there have been shown and described and pointed out fundamental novel features of the present invention as applied to a preferred embodiment thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for producing a coated and calendered paper, comprising:

adjusting the moisture content percentage of a manufactured base paper to between 4 and 14% of the total weight of the paper;

bringing the base paper web with said moisture content to a multi-nip calender;

calendering the base paper in the multi-nip calender to give it a maximum PPS-S10 roughness of 2.5 $\mu$m; and coating the calendered base paper with at least one layer of coating.

2. The method of claim 1 wherein the base paper contains at least 15% of filler.

3. The method of claim 1 wherein the base paper contains at least 20% of filler.

4. The method of claim 1 wherein the calendered base paper is coated with a layer of coating with a maximum grammage of 5 g/m$^2$.

5. The method of claim 2 wherein the calendered base paper is coated with a layer of coating with a maximum grammage of 5 g/m$^2$.

6. The method of claim 3 wherein the calendered base paper is coated with a layer of coating with a maximum grammage of 5 g/m$^2$.

7. The method of claim 1, wherein the calendered base paper is coated with a layer of coating with a maximum grammage of 3 g/m$^2$.

8. The method of claim 2, wherein the calendered base paper is coated with a layer of coating with a maximum grammage of 3 g/m$^2$.

9. The method of claim 3 wherein the calendered base paper is coated with a layer of coating with a maximum grammage of 3 g/m$^2$.

10. The method of claim 1, wherein the base paper is calendered to give it a PPS-S10 roughness of 1 to 1.5 $\mu$m.

11. The method of claim 2, wherein the base paper is calendered to give it a PPS-S10 roughness of 1 to 1.5 $\mu$m.

12. The method of claim 3, wherein the base paper is calendered to give it a PPS-S10 roughness of 1 to 1.5 $\mu$m.

13. The method of claim 1, wherein both sides of the paper are coated simultaneously.

14. The method of claim 4, wherein both sides of the paper are coated simultaneously.

15. The method of claim 5, wherein both sides of the paper are coated simultaneously.

16. The method of claim 6, wherein both sides of the paper are coated simultaneously.

17. The method of claim 1, wherein the base paper is coated by film-transfer coating.

18. The method of claim 2, wherein the base paper is coated by film-transfers coating.

19. The method of claim 4, wherein the base paper is coated by film-transfer coating.

20. The method of claim 5, wherein the base paper is coated by film-transfer coating.

21. The method of claim 1, wherein the base paper is coated by spray-application coating.

22. The method of claim 2, wherein the base paper is coated by spray-application coating.

23. The method of claim 4, wherein the base paper is coated by spray-application coating.

24. The method of claim 5, wherein the base paper is coated by spray-application coating.

25. The method of claim 1, wherein the paper is calendered using a calender comprising a plurality of hard heated rolls arranged on top of each other and a plurality of soft rolls set in between the hard heated rolls.

26. The method of claim 1, wherein the moisture content of the base paper is adjusted in a dryer cylinder group, and the base paper web is taken directly from the dryer cylinder group to the calender and from the calender directly to a coating station.

27. Paper comprising a base paper calendered in a multi-nip calender to a maximum PPS-S10 roughness of 2.5 $\mu$m and, at least on one side of the paper, a layer of coating with a maximum grammage of 5 g/m$^2$.

28. The paper of claim 27, wherein the grammage of at least one layer of coating is a maximum of 3 g/m$^2$.

29. The paper of claim 27, wherein the base paper contains mechanical pulp.

30. The paper of claim 27, in which the base paper contains at least 15% of filler.

31. The paper of claim 27, wherein the base paper comprises groundwood and filler.

32. The paper of claim 29, wherein the base paper comprises groundwood and filler.

33. The paper of claim 30, wherein the base paper comprises groundwood and filler.

34. The paper of claim 27, wherein the base paper's PPS-S10 roughness is a between 1 and 1.5 $\mu$m.

35. The paper of claim 30, wherein the base paper's PPS-S10 roughness is a between 1 and 1.5 $\mu$m.

36. The paper of claim 30, wherein the base paper contains at least 20% of filler.

37. The paper of claim 31, wherein the base paper contains at least 20% of filler.

38. The paper of claim 32, wherein the base paper contains at least 20% of filler.

39. The paper of claim 33, wherein the base paper contains at least 20% of filler.

* * * * *